United States Patent [19]

Petrovich

[11] Patent Number: 4,477,340

[45] Date of Patent: Oct. 16, 1984

[54] FROTH FLOTATION METHOD FOR RECOVERING METAL VALUES WITH DIHYDROXY OLEIC ACID

[76] Inventor: Vojislav Petrovich, 1935, W. Schiller St., Chicago, Ill. 60622

[21] Appl. No.: 416,286

[22] Filed: Sep. 9, 1982

Related U.S. Application Data

[63] Continuation-in-part of Ser. No. 241,560, Mar. 9, 1981, Pat. No. 4,368,116.

[51] Int. Cl.[3] ..... B03D 1/14

[52] U.S. Cl. ..... 209/166; 252/61

[58] Field of Search ..... 209/166, 167, 3, 9, 209/10; 252/61

[56] References Cited

U.S. PATENT DOCUMENTS 3,902,602 9/1975 Petrovich ..... 209/166

4,368,116 1/1983 Petrovich ..... 209/166

*Primary Examiner*—Bernard Nozick

[57] ABSTRACT

An improved method in concentrating oxide ores by froth flotation process which comprises subjecting a sufficiently fine sized ore of a metal which can change the valency state from higher to lower by the action of inorganic reducing compounds in the presence of an effective amount of dihydroxyoleic acid collector-frother; the indicated compounds provide selectivity and/or recovery of oxide minerals of iron, manganese, tin, titanium, vanadium, and wolfram, over silica and silicate gangue.

1 Claim, No Drawings

FROTH FLOTATION METHOD FOR RECOVERING METAL VALUES WITH DIHYDROXY OLEIC ACID

This invention is continuation in part of the invention Ser. No. 241,560 filed Mar. 9, 1981 now U.S. Pat. No. 4,368,116.

This invention relates to froth flotation of non-sulfide minerals from their ores using dihydroxyoleic acid as collector-frother, and more particularly by the addition of a reducing agent for the recovering of such metallic oxide minerals which consist of metals which can change the valency state from higher to lower by the action of inorganic reducing agents particularly such as sulfurous acid or the $SO_2$ dissolved in water, and the like reducing agents which are added still to the grinding and sizing circuit. After the grinding and sizing the dihydroxyoleic acid is added, or potassium salt during the conditionig stage.

Accordingly, this invention has as an object the provision of a practical and economical process for the beneficiation of iron, manganese, tin, titanium, vanadium, and wolfram minerals, i.e., metal values, which by the invented method are becoming amenable to froth flotation process, which until now were concentrated by gravity methods. Another object of this invention is to provide a mineral concentration treatment for the beneficiation of said metallic minerals, i.e., metal values, involving selective activation of a desired mineral and the production of a high-grade concentrate with maximum recovery of desired metallic mineral of above enumerated metals with a very low consumption of reagents.

Accordingly, this invention is to provide an improved froth flotation procedure in which through the application of dihydroxyoleic acid in conjunction with inorganic reducing agent which change the valency state at the surface of minerals, which thus activated for adheding the used dihydroxyoleic acid makes that wanted minerals set free from the gangue and selected from the group of iron, manganese, tin, titanium, vanadium, and wolfram in respective ores are activated and floated in the froth by agitating and aerating the pulp of mineral slurry.

By applying the present invention it is feasible to obtain not only selected metal values, but also an increased recovery of enumerated metal values in respective froth concentrate, with a reduction in reagent requirement and costs, a substantial advance is feasible in the field of recovering of diverse minerals.

A further object of this invention is to provide a process requiring one floatation operation to produce a finished concentrate with a reduction in reagent requirement and costs, and an increase in mineral recovery. A further object is to provide a process which tolerates relatively large amount of −150 mesh slimes without serious affecting reagent consumption or metallurgical results, so that the desliming and sizing of the feed is less critical. A further object of this invention is to provide a process permitting the plant to operate efficiently at lower conditioning time and lower per cent of solids levels.

In carrying out this invention in accordance with the foregoing principle, the selected ore is ground, sized, and then preferrably, although not necessarily deslimed by washing to remove colloidally dispersed material, and thereafter the sands are diluted to a pulp consistency of generally about 25 per cent solids. Thereafter, the pulp is conditioned for several minutes by agitating with an amount of the order from 0.02 to 0.2 kg per ton of ore treated of sulfurous acid, the reducing agent, and simultaneously is added dihydroxyoleic acid or its potassium salt in an amount of the order from 0.01 to 0.1 kg per ton ore treated. Said additions to a distinct pulp of mineral slurry produce a floating froth product of selected mineral of the respective mineral slurry by agitating and aerating. Besides a rougher a cleaner procedure may be employed, and the invention can be utilized in a cyclic process wherein the decanted and filtered spent water and the middling ore fraction are returned to the process, saving in this way the unused reagents, as well as omitting the spoiling of environment water courses.

The invented process further reduces the need for close plant control in critical areas, such as desliming, sizing conditioning, and reagent rates, reducing flotation reagent requirement and processing costs. Thus, efficient results and considerable reagent economy have been effected in the practicing this invention, and to this end it is preferred to employ said dihydroxyoleic acid or its potassium salt in small amount only, because it develops sufficient froth, being thus effective collector-frother.

The following Examples will facilitate a more complete understanding of the present invention but they are not meant to limit the scope of the invention to the specific embodiments incorporated therein.

TABLE I

| Example ore treated | Promoter kg/t | Collector kg/t | Feed % | Conc. % | Tailing % |
|---|---|---|---|---|---|
| Specular hematite | Sulfurous acid | Dihydroxyoleic acid Potassium salt | Fe | Fe | Fe |
| | 0.08 | 0.06 | 30.0 | 62.4 | 7.9 |
| Psylomelan | the same | the same | Mn | Mn | Mn |
| | 0.06 | 0.06 | 26.4 | 53.8 | 4.8 |
| Cassiterite | the same | the same | Sn | Sn | Sn |
| | 0.05 | 0.05 | 7.2 | 71.1 | 2.6 |
| Rutile | the same | the same | $TiO_2$ | $TiO_2$ | $TiO_2$ |
| flour | 0.10 | 0.20 | pure | pure | — |
| Scheelite | the same | the same | $WO_3$ | $WO_3$ | $WO_3$ |
| | 0.04 | 0.04 | poor mater. | good conc | — |

All investigated ores with dihydroxyoleic acid and sulfurous acid yielded high recoveries and pure concentrates. In each tailing it was visible under microscope only the coarse grains of wanted minerals.

The Table I, shows that dihidroxyoleic acid in conjunction with an reducing agent is excellent collector-frother for metallic minerals of various metals such as of iron, manganese, tin, titanium, vanadium, and wolfram.

Considering the results, the conclusion is: that not only the ratio of concentration of valuable minerals is considerably raised, but also is highly performed with reagents which intil now have not been known and used. A feasible froth flotation process is modified by which the ratio of depressed gangue is considerably lowered, while the ratio of valuable mineral is considerably hightened. Therefore, the use according to the present invention of dihydroxyoleic acid in conjunction with reducing agents for accomplishing the purpose of collecting minerals of iron, manganese, tin, titanium, vanadium, and wolfram in a process of unaffected gangue and certain secondary valuable minerals occasionally present in a distinct mineral slurry constitutes a marked advance in the art of froth flotation, and is highly advantageous in improving the selectivity by the used collector, thus improving the grade of concentrate.

What is claimed is:

1. In concentrating by froth flotation of metallic ores selected from the group of iron, manganese, tin, titanium, vanadium, and wolfram, which includes the subjecting of said ore material when finely ground to froth flotation process in the presence of dihydroxyoleic acid or its potassium salt, and in the presence of sulfurous acid; the step of adding to the mineral slurry an amount of the order from 0.01 to 0.1 kg per ton of ore treated of said dihydroxyoleic acid, and an amount of the order from 0.02 to 0.2 kg per ton of ore treated of sulfurous acid; said additions to aqueous dispersion of ore produce a floating froth product of said mineral value by continous agitation and aeration of the aqueous dispersion of ore, and separating and recovering the iron, manganese, tin, titanium, vanadium, wolfram mineral value as float froth concentrate product.

* * * * *